US007954890B2

(12) United States Patent
Wright

(10) Patent No.: US 7,954,890 B2
(45) Date of Patent: Jun. 7, 2011

(54) FOLDING CHAIR

(75) Inventor: Douglas G. Wright, Morristown, TN (US)

(73) Assignee: Meco Corporation, Greeneville, TN (US)

( * ) Notice: Subject to any disclaimer, the term of this patent is extended or adjusted under 35 U.S.C. 154(b) by 80 days.

(21) Appl. No.: 12/033,615

(22) Filed: Feb. 19, 2008

(65) Prior Publication Data

US 2008/0197676 A1 Aug. 21, 2008

Related U.S. Application Data

(60) Provisional application No. 60/890,812, filed on Feb. 20, 2007.

(51) Int. Cl.
*A47C 4/00* (2006.01)

(52) U.S. Cl. ..... 297/16.1; 297/46; 297/47; 297/49; 297/59

(58) Field of Classification Search ..... 297/16.1, 297/46, 47, 49, 59
See application file for complete search history.

(56) References Cited

U.S. PATENT DOCUMENTS

| | | | | |
|---|---|---|---|---|
| 1,922,305 | A * | 8/1933 | Kovats | 297/47 |
| 1,946,082 | A * | 2/1934 | Kovats | 297/47 |
| 1,976,567 | A * | 10/1934 | Kovats | 297/47 |
| 1,981,387 | A * | 11/1934 | Kovats | 297/47 |
| 2,005,715 | A * | 6/1935 | Kovats | 297/47 |
| 2,224,399 | A | 12/1940 | Komarik | |
| 2,225,306 | A * | 12/1940 | Kovats | 297/47 |
| 2,244,399 | A * | 6/1941 | Kovats | 297/47 |
| 2,247,799 | A * | 7/1941 | Boardman | 297/47 |
| 2,541,036 | A * | 2/1951 | Christensen | 297/47 |
| 2,541,130 | A * | 2/1951 | Thal | 297/47 |
| 2,541,131 | A * | 2/1951 | Thal | 297/47 |
| 2,705,043 | A * | 3/1955 | Hoven | 297/47 |
| 3,453,023 | A * | 7/1969 | Barker, Jr. | 297/47 |
| 4,889,383 | A | 12/1989 | Jones | |
| 5,069,503 | A | 12/1991 | Martinez | |
| 5,244,250 | A | 9/1993 | Nordmeyer | |
| 6,511,122 | B1 | 1/2003 | Chen | |

FOREIGN PATENT DOCUMENTS

| | | |
|---|---|---|
| JP | 2002-159363 | 6/2002 |
| KR | 20-1997-016037 | 5/1997 |

OTHER PUBLICATIONS

International Search Report and Written Opinion, dated Jun. 11, 2008.

* cited by examiner

*Primary Examiner* — Laurie K Cranmer
(74) *Attorney, Agent, or Firm* — McGuireWoods LLP

(57) ABSTRACT

A folding chair is disclosed. The chair includes a plurality of legs, including front and back legs, a seat, and a folding unit. The folding unit is attached to the legs and the seat, and it is configured to fold the legs using a force applied to at least one of the legs. The front legs nest beside the back legs.

17 Claims, 8 Drawing Sheets

FOLDING CHAIR

CROSS-REFERENCE TO RELATED APPLICATIONS

This application claims priority under 35 U.S.C. §119(e) to provisional U.S. Patent Application No. 60/890,812 filed on Feb. 20, 2007, the disclosure of which is expressly incorporated by reference herein in its entirety.

BACKGROUND OF THE INVENTION

1. Field of the Invention

The invention is directed to foldable furniture, and more particularly to a foldable chair having a unique folding frame structure with a push handle.

2. Related Art

Various folding chairs are and have been commercially available. A foldable chair or the like is intended to reduce space when arranged in a storage position. However, as discussed below, most prior art folding chairs suffer from one or more drawbacks such as being bulky, trouble-prone, unreliable in use, visually unattractive and in particular suffer from difficult to operate mechanisms and less rigid construction.

U.S. Pat. No. 1,981,387 by J. Kovats discloses a folding chair construction, in which the back, legs and seat member can be easily and quickly folded together into a minimum space, and in which the back and leg members can be folded and unfolded at the same time and in a single operation. Also, in the U.S. Pat. No. 1,981,387, the back member and the legs are locked in the upright or unfolded position by locking means, such as a locking plate having a notch configured to engage a pin attached to the back leg. A wire connection is coupled between the locking plate and a slidably mounted bar located at the front of the seat member. By pushing the pressing bar, the locking plate is disengaged from the pin and the back member and legs are unlocked.

U.S. Pat. No. 2,225,306 by J. Kovats discloses a simplified folding chair structure, in which the back rest and legs are interconnected by a pair of link members on both sides of the chair, respectively. Each link member is connected to the front leg, the rear leg and the back rest so that they all move together in opening and closing operations of the chair. A releasable latch member is provided to prevent accidental collapse of the chair and securely hold the chair when the chair is unfolded. The latch member is operated by a spring member, which is pulled down when it is desired to fold the chair.

U.S. Pat. No. 1,946,082 by J. Kovats discloses a folding chair wherein the back of the chair may be collapsed against one side of the chair seat while one pair of chair legs are collapsed against the other side of the chair seat member and the other pair of chair legs are swung to a position in or approximately in the plane of the seat member. Further shown therein is a single frame structure for a seat member having a front portions and side portions.

U.S. Pat. No. 2,224,399 by J. Kovats discloses locking means that securely locks the actuating mechanism for a folding chair in an extended position. The locking means includes a latch configured to automatically engage keeper means mounted on the underside of the seat member when the chair is moved to the extended position.

Each of the prior art chairs suffer from at least difficult to operate mechanisms and less rigid construction. Accordingly, there is a need for an improved folding chair.

SUMMARY OF THE INVENTION

The invention meets the foregoing need and other advantages apparent from the discussion herein. Accordingly, in one aspect of the invention, a folding chair has legs, a mechanical unit attached to the legs and configured to selectively prevent the legs from being folded, and a seat covering the mechanical unit. The mechanical unit may include a folding unit for folding legs using a force applied to at least one of the legs, and a handle mechanically engaged to the folding unit to allow the legs to be folded upon being activated.

Accordingly, in one aspect of the invention, a folding chair includes a plurality of legs, including a front leg and a back leg, a seat, and a folding unit. The folding unit is attached to the legs and the seat, and it is configured to fold the legs using a force applied to at least one of the legs. In addition, the front legs nest beside the back legs.

The folding chair may include a back support, which may also be folded by the folding unit. The folding unit may include a locking mechanism that prevents the legs from being folded when the locking mechanism is engaged. The locking mechanism may include a hook and a pin that engage each other when the chair is unfolded. The locking mechanism may include either a push bar or a handle to disengage the mechanism so that the legs may be folded.

According to another aspect of the invention, a folding chair includes a plurality of legs, including a front leg and a back leg, a seat, and a mechanical unit. The mechanical unit is attached to the legs and the seat, and it is configured to fold the legs using a force applied to at least one of the legs. In addition, the front legs nest beside the back legs.

The folding chair may include a back support, which may also be folded by the mechanical unit. The mechanical unit may include a locking mechanism that prevents the legs from being folded when the locking mechanism is engaged. The locking mechanism may include a hook and a pin that engage each other when the chair is unfolded. The locking mechanism may include either a push bar or a handle to disengage the mechanism so that the legs may be folded.

In yet another aspect of the invention, a mechanical unit for folding a chair includes a frame, a hinge, at least one leg connected to the frame by the hinge, a first link connected to the frame, a swing link connected to the first link and the frame, and a second link connected to the swing link. Movement of the second link causes the leg to rotate relative to the hinge as a result of movement of the swing link and the first link.

The mechanical unit may include a first bracket connected to the frame and a second bracket connected to both the second link and a second leg. A force applied to the second leg moves the second link, causing the first leg to rotate, and rotates the second leg. The mechanical unit may include a third bracket connected to both the first and second brackets, as well as a back support. When the force is applied to the second leg, it also rotates the third bracket and the back support. The mechanical unit may include a locking mechanism that prevents the legs from being folded when the locking mechanism is locked. The locking mechanism may include either a push bar or a handle that disengages the locking mechanism so that the chair can be folded. A folding chair may be constructed with the mechanical unit.

Additional features, advantages, and embodiments of the invention may be set forth or apparent from consideration of the following detailed description, drawings, and claims. Moreover, it is to be understood that both the foregoing summary of the invention and the following detailed description are exemplary and intended to provide further explanation without limiting the scope of the invention as claimed.

BRIEF DESCRIPTION OF THE DRAWINGS

The accompanying drawings, which are included to provide a further understanding of the invention, are incorporated in and constitute a part of this specification, illustrate embodiments of the invention and together with the detailed description serve to explain the principles of the invention. No attempt is made to show structural details of the invention in more detail than may be necessary for a fundamental understanding of the invention and the various ways in which it may be practiced. In the drawings.

DETAILED DESCRIPTION OF THE INVENTION

Figure 1:
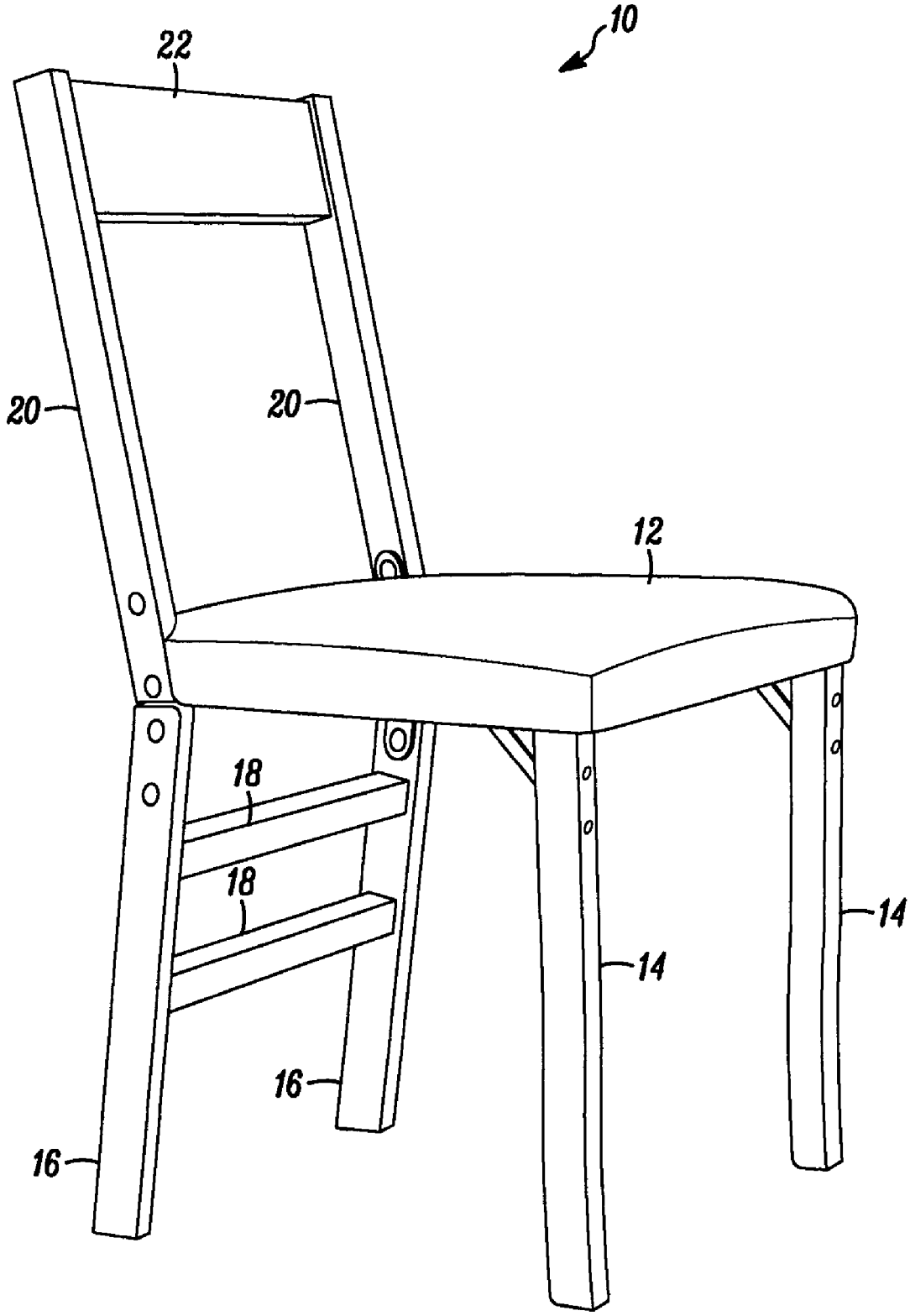
FIG. 1 shows a perspective view of a folding chair constructed according to the principles of the invention.

The embodiments of the invention and the various features and advantageous details thereof are explained more fully with reference to the non-limiting embodiments and examples that are described and/or illustrated in the accompanying drawings and detailed in the following description. It should be noted that the features illustrated in the drawings are not necessarily drawn to scale, and features of one embodiment may be employed with other embodiments as the skilled artisan would recognize, even if not explicitly stated herein. Descriptions of well-known components and processing techniques may be omitted so as to not unnecessarily obscure the embodiments of the invention. The examples used herein are intended merely to facilitate an understanding of ways in which the invention may be practiced and to further enable those of skill in the art to practice the embodiments of the invention. Accordingly, the examples and embodiments herein should not be construed as limiting the scope of the invention, which is defined solely by the appended claims and applicable law. Moreover, it is noted that like reference numerals represent similar parts throughout the several views of the drawings.

FIG. 1 shows a perspective view of a folding chair 10 constructed according to the principles of the invention. The folding chair 10 includes a seat 12, legs, such as front legs 14 and rear legs 16, and a back support, such as vertical bars 20 and a panel 22. The folding chair 10 further includes a novel more rigid construction as shown in the figures and described below. Additionally, the folding chair 10 includes an improved novel mechanism to initiate folding as shown in the figures and described below.

Figure 2:
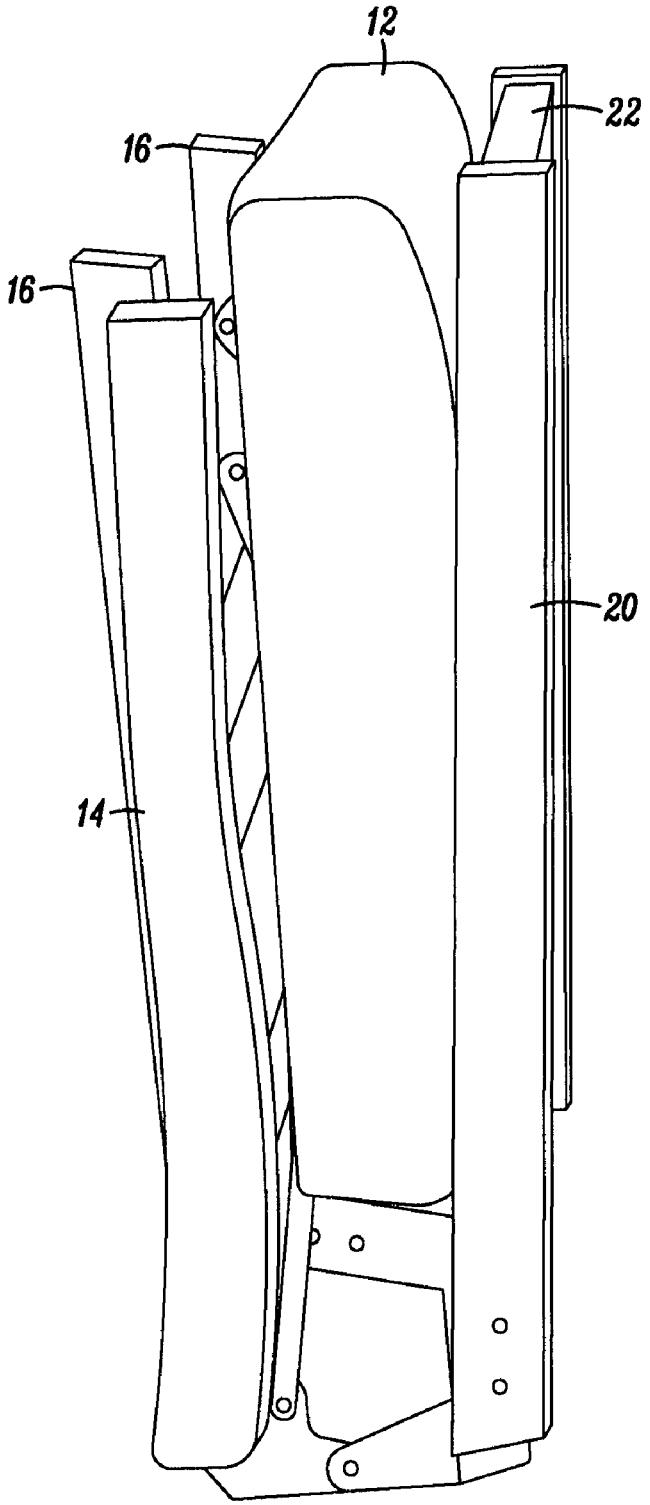
FIG. 2 shows a side view of the folding chair of FIG. 1 in a folded position.
Figure 3:
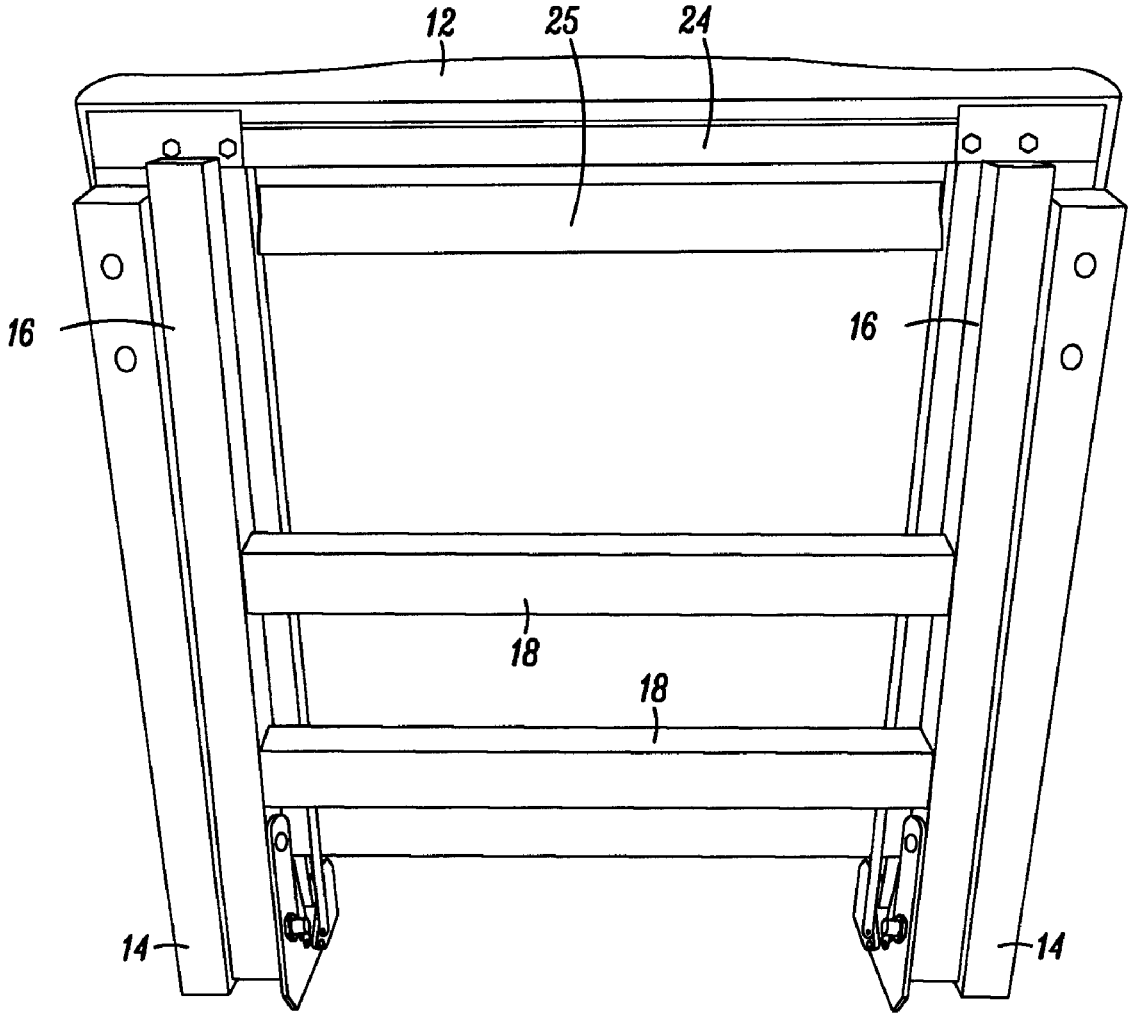
FIG. 3 shows a bottom view of the folding chair of FIG. 1 in a folded position.

The folding chair 10 may include other components such as links 18 bridging the rear legs 16 or the like. FIG. 2 shows a side view of the folding chair 10 in a folded position, and FIG. 3 shows a bottom view of the folding chair 10 in the folded position. As shown in FIG. 3, a distance between the rear legs 16 may be less than a distance between the front legs 14 such that the rear legs 16 are arranged between the front legs 14 when the folding chair 10 is folded.

A mechanical unit 24 may be arranged at a bottom side of the seat 12 to establish folding and locking of the various chair parts. The mechanical unit 24 may be configured to be substantially covered by the seat 12 although certain parts may not be covered to provide structural rigidness. A push handle 25 may be provided at the bottom side of the seat 12 to unlock the folding mechanism of the folding chair 10 to achieve the unfolded position, which will be explained below in detail.

Figure 4:
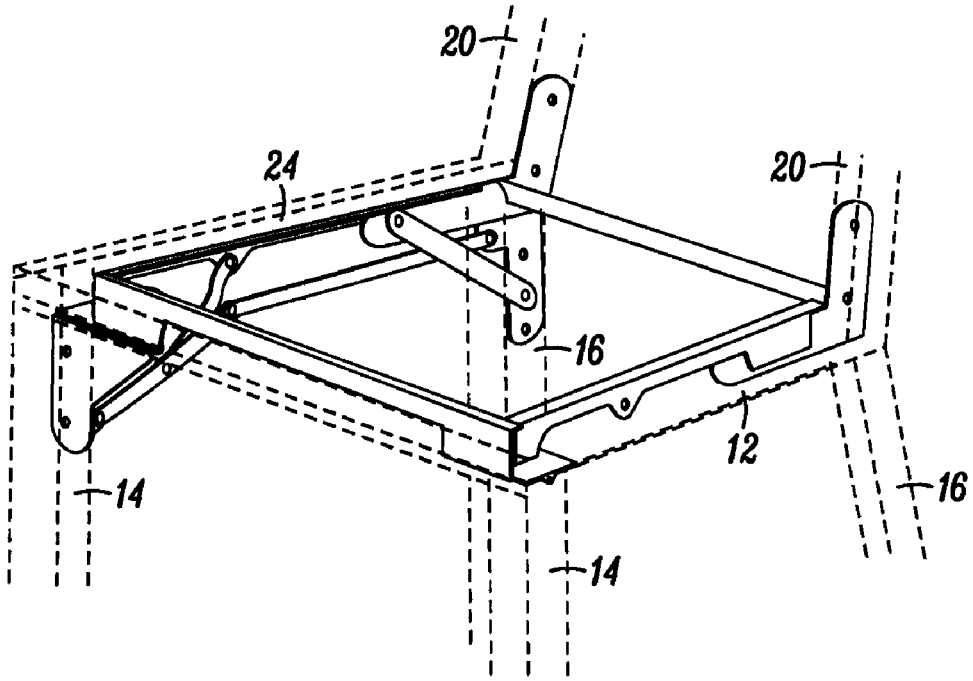
FIG. 4 shows a perspective view of a frame structure of the folding chair of FIG. 1.
Figure 5:
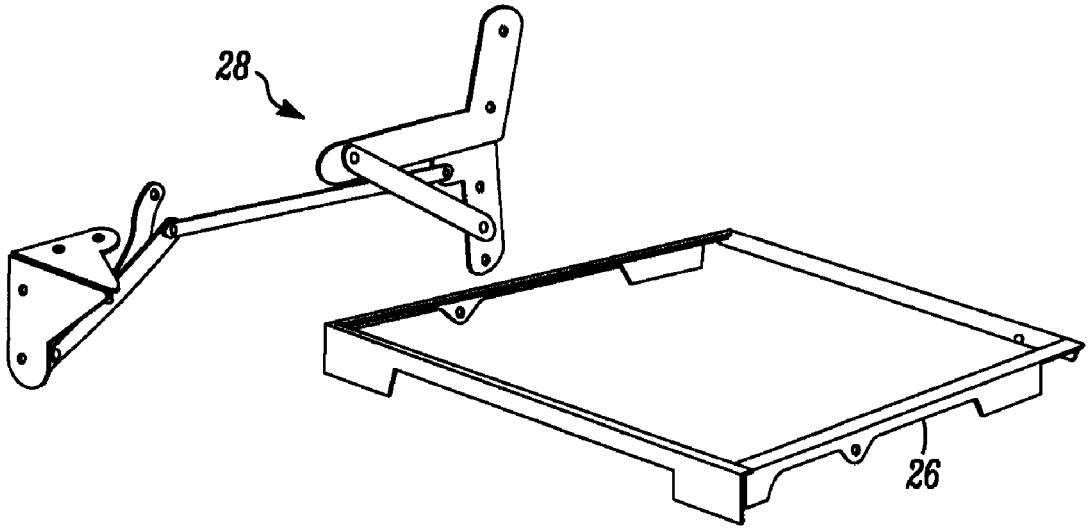
FIG. 5 shows an exploded perspective view of the frame structure of FIG. 4.

FIG. 4 shows a perspective view of the mechanical unit 24, and FIG. 5 shows an exploded view of the mechanical unit 24. As shown therein, the mechanical unit 24 may be divided into two parts: a frame 26 and linkage 28 attached to the frame 26. Although FIGS. 4 and 5 show only one linkage 28 provided on one side of the frame 26, as would have been obvious to one of ordinary skill in the art, another linkage may be provided on the opposite side of the frame 26 for the purpose of this invention as shown in FIG. 4.

Figure 6:
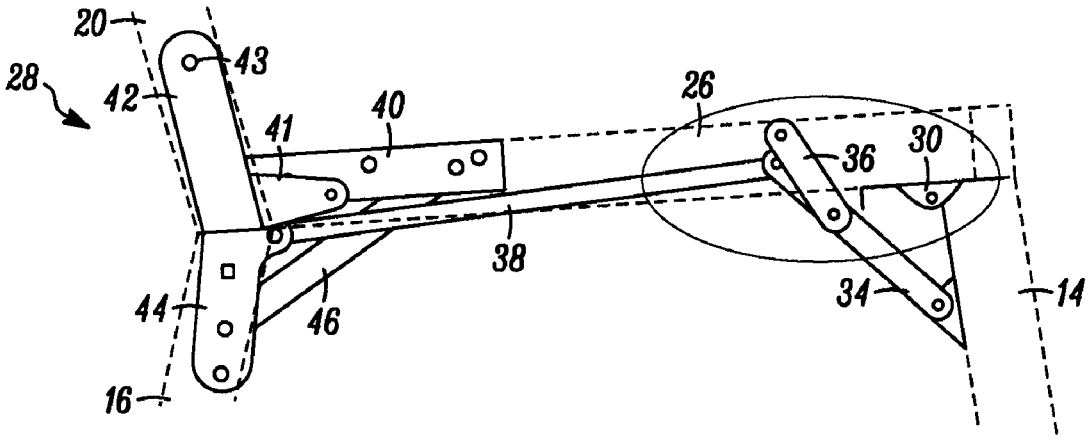
FIG. 6 shows a side view of the frame structure of FIG. 5 in an unfolded position.

FIG. 6 shows a side view of the linkage 28 when the folding chair 10 is in the unfolded position. As shown in FIG. 6, the linkage 28 may be an assembly of various parts to establish the folding mechanism. The front leg 14 is pivotally attached to the frame 26 by a hinge 30. A swing link 34 is coupled between the leg 14, link 36, and a link 38. Specifically speaking, one end of the swing link 34 is pivotally connected to the leg 14, and the other end is pivotally connected to the link 38. Similarly, the link 36 is provided between the swing link 34 and frame 26, and both ends may be pivotally connected to the swing link 34 and frame 26, respectively. The link 38, pivotally connected to the swing link 34 at its one end, may also be pivotally connected to a bracket 44 at the other end. The bracket 44 is pivotally connected to a bracket 42 at a pivot 41. The rear leg 16 is attached to the bracket 44, and the vertical bar 20 may be connected to the bracket 42. The bracket 42 may also be pivotally connected to a bracket 40 at a pivot 43. The bracket 40 is connected to the frame 26. A link 46 is pivotally coupled to the bracket 44 and the bracket 40. As shown in FIG. 6, when the folding chair 10 is in the unfolded position, the swing link 34 and link 42 may be visible but other components of the frame 26 and linkage 28 may not be visible.

Figure 7:
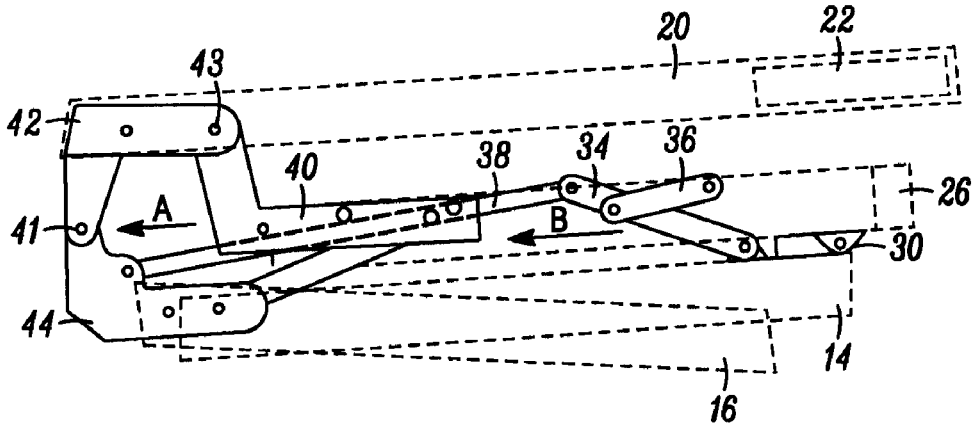
FIG. 7 shows the frame structure of the frame structure of FIG. 6 in a folded position.

FIG. 7 shows a side view of the linkage 28 when the folding chair 10 is in the folded position. Upon folding the rear leg 16, the bracket 44 is rotated counter-clock wise with respect to the pivot 41. Since the link 46 maintains the same distance between the bracket 40 and bracket 44, the pivot 41 is pushed in the direction of arrow A. This results in pulling the link 38 and swing link 34 in the direction of arrow B while the link 36 enables the link 38 and swing link 34 to pull the legs 12 under the bottom surface of the seat 12. Thus, a force applied to fold the rear leg 16 is transferred to the hinge 30, resulting in folding the front legs 16, 16. Also, since the bracket 42 is pivotally connected to the bracket 40, the bracket 42 rotates clockwise with respect to the pivot 41 when the rear leg 16 is folded and the pivot 41 is moved in the direction of arrow A. Thus, the force applied to fold the rear leg 16 is transferred to turn the bracket 42, resulting in folding the vertical bar 20.

Figure 8:
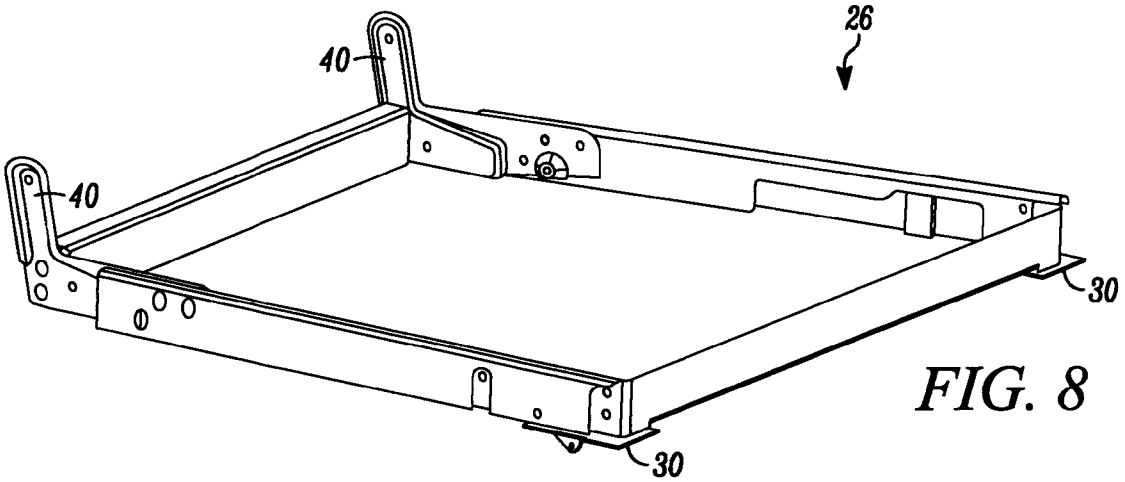
FIG. 8 shows another perspective partial view of the frame structure of FIG. 4.
Figure 9:
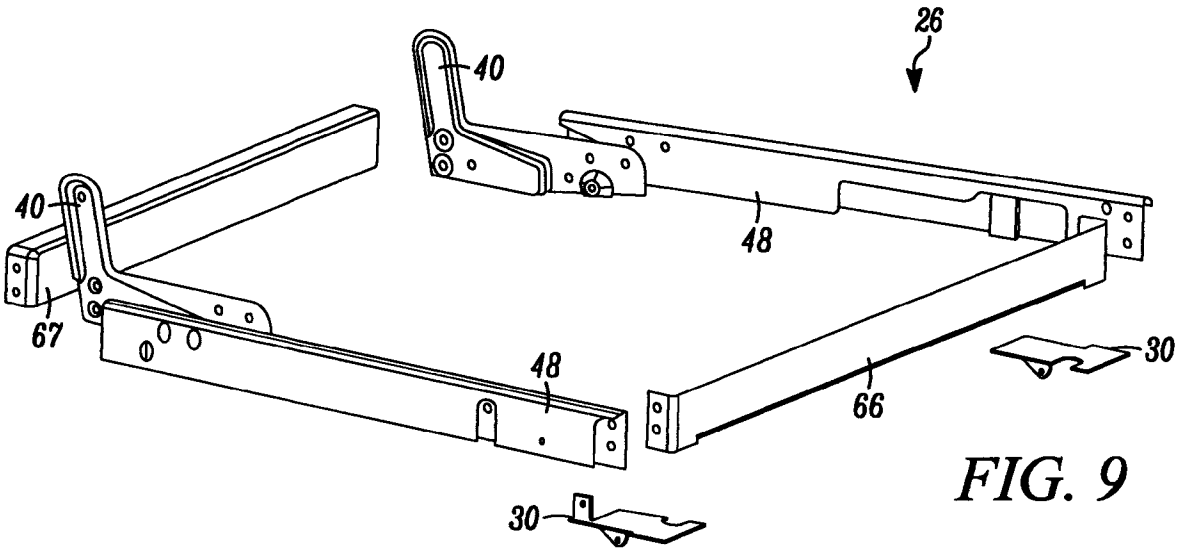
FIG. 9 shows another exploded partial perspective view of the frame structure of FIG. 8.

FIG. 8 shows a perspective view of the frame 26 and the brackets 40 and hinges 30 attached to the frame 26. FIG. 9 shows an exploded perspective view of the structure shown in FIG. 8. As shown therein, the frame 26 may be formed by assembling side panels 48, a front panel 66, and a rear panel 67. The panels 48, 66, 67 may be formed of metal or any other material that has sufficient structural rigidity. The panels 48, 66, 67 may also have a stamped construction.

Figure 10:
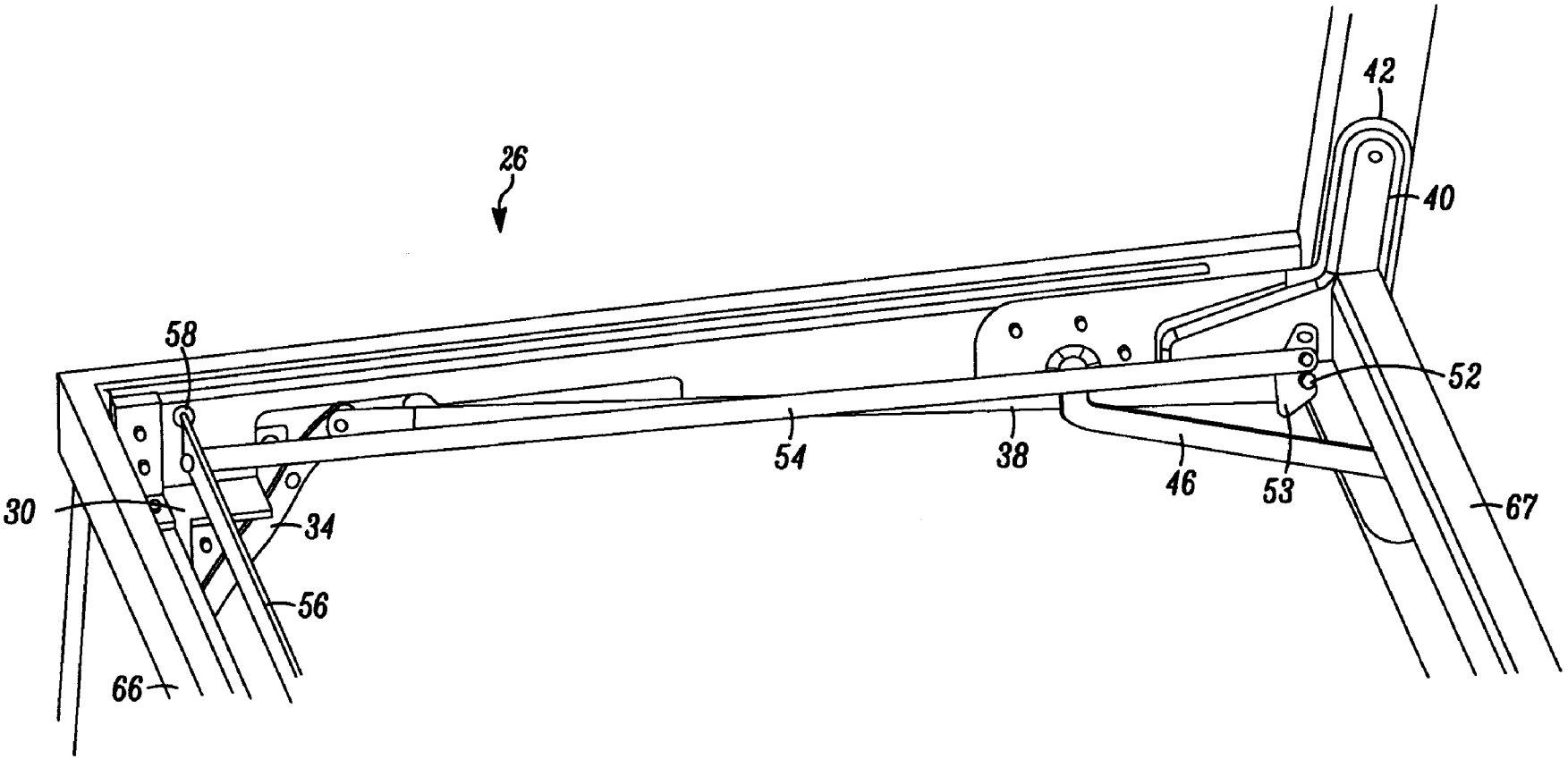
FIG. 10 shows another perspective view of the frame structure of FIG. 4 with an unlocking unit.
Figure 11:
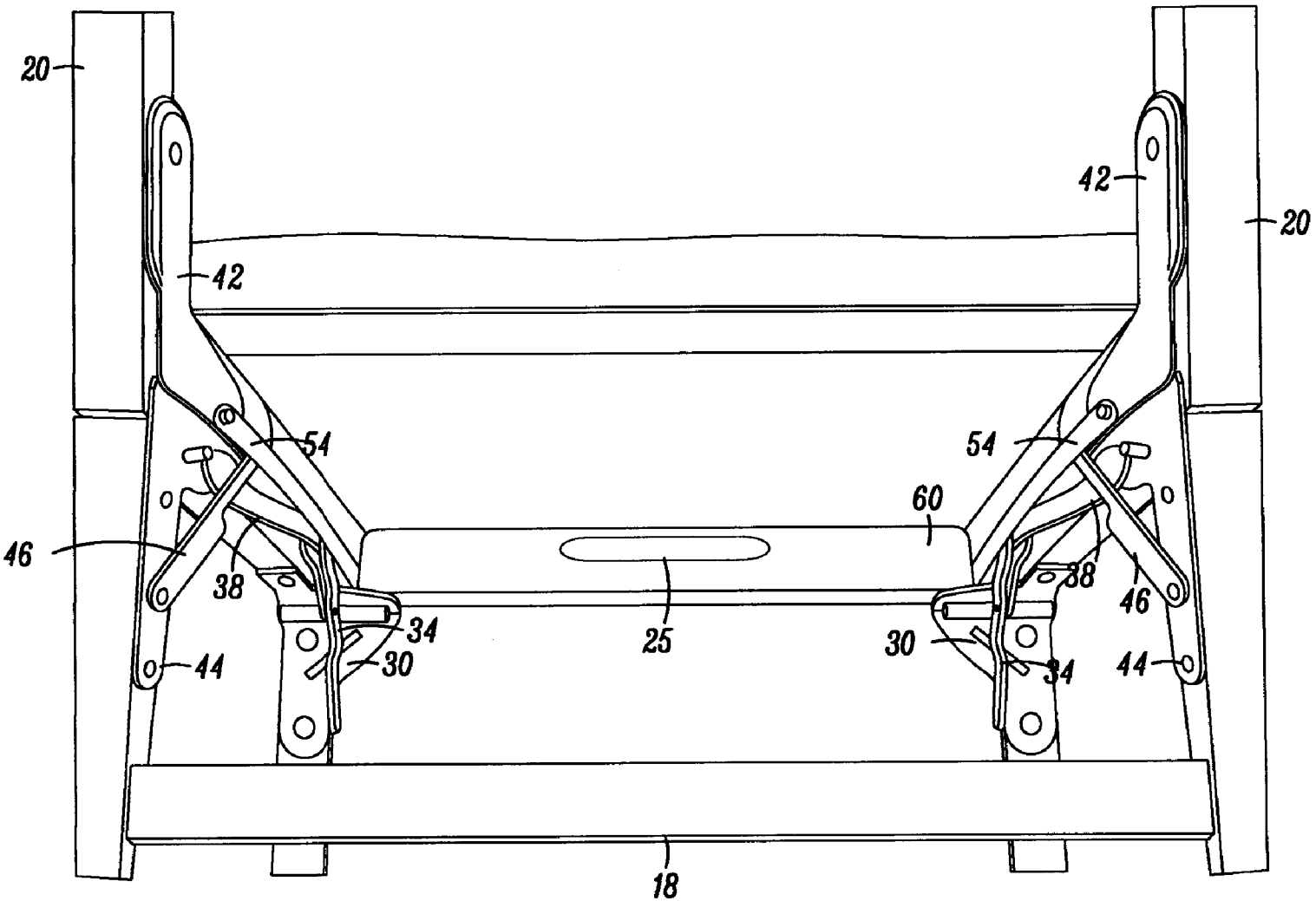
FIG. 11 shows a perspective side/bottom view of the frame structure of FIG. 10 with a push handle.

FIG. 10 shows a locking/unlocking mechanism that may be added to the folding chair 10 constructed according to the principles of the invention. The folding chair 10 may be further equipped with a post 52 formed on the bracket 44 and a hook 53 pivoted on the bracket 40. The hook 53 may be operatively connected to a rod 54 extending to a push bar 56. The push bar 56 may be pivotally connected to the frame 26 with a pivot 58. A spring or the like may be coupled between the push bar 56 and the front panel 66 to maintain engagement between the post 52 and hook 53. The post 52 and hook 53 are configured such that they are automatically locked to each other when the folding chair 10 is fully unfolded. Also, once the post 52 and hook 53 are locked to each other, they may stay locked and the folding chair 10 may not be folded until the push bar 56 is pushed and the hook 53 is unlocked from the post 52. As shown in FIG. 11, a push handle 25 may be provided to provide a better grip on operating surface for users. The push handle 25 may be provided to cover or actuate the push bar 56 or may replace the push bar 56. This makes unlocking the chair (to fold) easier.

While the invention has been described in terms of exemplary embodiments, those skilled in the art will recognize that the invention can be practiced with modifications in the spirit and scope of the appended claims. These examples given above are merely illustrative and are not meant to be an exhaustive list of all possible designs, embodiments, applications or modifications of the invention.

What is claimed is:

1. A folding chair, comprising:

a frame;

a plurality of legs comprising at least one front leg and at least one back leg;

a seat attached to the frame; and a folding unit attached to the frame and the plurality of legs and configured to pivotally move the plurality of legs between a folded position and an unfolded position when a force is applied to pivotally move at least one of the plurality of legs, wherein the folding unit comprises:

a swing link having a first end pivotally connected to the at least one front leg and a second end;

a first link having a first end pivotally attached to the frame and a second end pivotally connected to the swing link; and a second link having a first end pivotally connected directly to the second end of the swing link and extending towards the at least one back leg, wherein the at least one back leg pivotally moves between the folded position and the unfolded position when the second link is moved by a pivotal movement of the swing link with respect to the at least one front leg and the first link, and wherein the second end of the first link is pivotally connected only to the swing link, and the first end of the second link is pivotally connected directly only to the second end of the swing link.

2. The folding chair of claim 1, further comprising a back support.

3. The folding chair of claim 2, wherein the folding unit is further configured to pivotally move the back support when the force is applied to pivotally move at least one of the plurality of legs.

4. The folding chair of claim 1, wherein the folding unit comprises a locking unit configured to selectively prevent the plurality of legs from being folded when the plurality of legs are in the unfolded position.

5. The folding chair of claim 4, wherein the locking unit comprises:

a hook and a pin configured to engage each other when the plurality of legs are in the unfolded position; and a handle configured to disengage the hook and the pin so that the chair may be folded.

6. A mechanical unit for a folding chair comprising at least one leg, the unit comprising:

a frame;

a hinge configured to connect the at least one leg to the frame;

a first link pivotally connected to the frame;

a swing link pivotally connected to the first link and further pivotally connected to the at least one leg;

a second link pivotally connected directly to the swing link, wherein a movement of the second link in a first direction causes the at least one leg to rotate relative to the hinge by a movement of the swing link and the first link;

a first bracket connected to the frame; and a second bracket pivotally connected to the second link and further pivotally connected to a second at least one leg, wherein a force applied to the second at least one leg moves the second link in the first direction and rotates the second at least one leg.

7. The mechanical unit of claim 6, further comprising:

a third bracket pivotally connected to the first bracket and further pivotally connected to the second bracket, and further connected to a back support, wherein the force applied to the second at least one leg rotates the third bracket and the back support.

8. The mechanical unit of claim 6, further comprising a locking mechanism configured to selectively prevent the legs from being folded when the locking mechanism is in a locked position, wherein the locking mechanism comprises a push bar or a handle configured to disengage the locking mechanism so that the chair may be folded.

9. A folding chair constructed with the mechanical unit of claim 6.

10. The mechanical unit of 6, wherein a first end of the first link is pivotally connected to the frame and a second end of the first link is pivotally connected only to the swing link.

11. The mechanical unit of claim 10, wherein a first end of the swing link is pivotally connected to the at least one leg and a second end of the swing link is pivotally connected directly only to the second link.

12. The mechanical unit of claim 11, wherein the second end of the first link is pivotally connected directly to a portion of the swing link between the first and second ends thereof.

13. A folding chair, comprising:

a frame;

a plurality of legs comprising at least one front leg and at least one back leg;

a seat attached to the frame; and a folding unit attached to the frame and the plurality of legs and configured to pivotally move the plurality of legs between a folded position and an unfolded position when a force is applied to pivotally move at least one of the plurality of legs, wherein the folding unit comprises:

a swing link having a first end pivotally connected to the at least one front leg and a second end;

a first link having a first end pivotally attached to the frame and a second end pivotally connected to the swing link; and a second link having a first end pivotally connected directly to the second end of the swing link and extending towards the at least one back leg, wherein the at least one back leg pivotally moves between the folded position and the unfolded position when the second link is moved by a pivotal movement of the swing link with respect to the at least one front leg and the first link, and wherein the second end of the first link is pivotally connected directly to a portion of the swing link between the first and second ends thereof.

14. The folding chair of claim 13, further comprising a back support.

15. The folding chair of claim 14, wherein the folding unit is further configured to pivotally move the back support when the force is applied to pivotally move at least one of the plurality of legs.

16. The folding chair of claim 13, wherein the folding unit comprises a locking unit configured to selectively prevent the plurality of legs from being folded when the plurality of legs are in the unfolded position.

17. The folding chair of claim 16, wherein the locking unit comprises:

a hook and a pin configured to engage each other when the plurality of legs are in the unfolded position; and a handle configured to disengage the hook and the pin so that the chair may be folded.

* * * * *